US006506064B1

(12) United States Patent
Wu

(10) Patent No.: US 6,506,064 B1
(45) Date of Patent: Jan. 14, 2003

(54) PICK-AND-PLACE CAP FOR CONNECTOR HAVING BAIL LATCHES

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/027,275

(22) Filed: Dec. 20, 2001

(51) Int. Cl.[7] ..... H01R 13/44
(52) U.S. Cl. ..... 439/135; 439/940
(58) Field of Search ..... 439/135, 136, 439/345, 148, 150, 940

(56) References Cited

U.S. PATENT DOCUMENTS 5,026,295 A * 6/1991 Fong et al. ..... 439/135
5,076,619 A * 12/1991 Chi ..... 439/135
6,015,305 A * 1/2000 McHugh et al. ..... 439/135
6,135,795 A * 10/2000 Ho et al. ..... 439/135

* cited by examiner

*Primary Examiner*—Hien Vu
(74) *Attorney, Agent, or Firm*—Wei Te Chung

(57) ABSTRACT

A pick-and-place cap is provided for a connector having bail latches. The pick-and-place cap includes an elongate board having upper and lower surfaces. Two catches are formed on opposite end portions of the board and extend from the lower surface thereof. Each catch forms a barb for engaging a corresponding latch of the connector thereby attaching the pick-and-place cap to the connector and securing the latches with respect to the connector. Two grooves are defined in the upper surface of the flat board between a middle portion and each of the end portions to allow pivotal movement of the middle portion with respect to the end portions which drives the end portions to disengage the catches from the latches and thus releasing the latches and the connector. A collapsible, hollow barrel is formed on the lower surface of the middle portion to support the middle portion at a position where the catches remain engaged with the latches. When an external force acts on the middle portion, the hollow barrel collapses, allowing the middle portion to move to a position where the catches are forced to disengage from the latches.

6 Claims, 4 Drawing Sheets

PICK-AND-PLACE CAP FOR CONNECTOR HAVING BAIL LATCHES

BACKGROUND OF THE INVENTION

1. Field of the Invention

The present invention generally relates to a connector having bail latches for latching the connector to a mating connector, and more particular to a pick-and-place cap engageable with the latches for easy handling of the connector and releasably securing the latches during handling and shipment.

2. The Related Arts

Connectors having bail latches allowing mating with a mating connector are widely known. The bail latches are allowed to move between a locked position where the latches lock the connectors together and a released position where the latches do not engage the mating connector and thus allowing the connectors to separate from each other. The conventional bail latches have certain deficiencies among which being not able to firmly secure the latches during shipment and handling is one of the major concerns of connector manufacturers. Certain bail latches are made of wires, such as U.S. Pat. No. 5,924,886. The wire-made bail latches can be temporarily fixed to the connector by forming a portion that frictionally engages a surface of the connector. However, bail latches made by stamping metal plates are difficult to employ such a design.

On the other hand, a pick-and-place cap is commonly attached to the housing of a connector for easily handling the connector. The pick-and-place cap is removed after the connector is mounted to for example a circuit board. Removing the pick-and-place cap is an additional job, requiring additional labor and costs.

Thus, a device for releasably securing the bail latches and in the meantime facilitating handling of a connector is desired for simultaneously solving the above problems.

SUMMARY OF THE INVENTION

It is an object of the present invention to provide a pick-and-place cap for a connector having bail latches.

Another object of the present invention is to provide a device to temporarily securing bail latches of a connector during shipment and handling.

To achieve the above objects, in accordance with the present invention, a pick-and-place cap is provided for a connector having bail latches. The pick-and-place cap comprises an elongate board having upper and lower surfaces. Two catches are formed on opposite end portions of the board and extend from the lower surface thereof. Each catch forms a barb for engaging a corresponding latch of the connector thereby attaching the pick-and-place cap to the connector and securing the latches with respect to the connector. Two grooves are defined in the upper surface of the flat board between a middle portion and each of the end portions to allow pivotal movement of the middle portion with respect to the end portions which drives the end portions to disengage the catches from the latches and thus releasing the latches and the connector. A collapsible, hollow barrel is formed on the lower surface of the middle portion to support the middle portion at a position where the catches remain engaged with the latches. When an external force acts on the middle portion, the hollow barrel collapses, allowing the middle portion to move to a position where the catches are forced to disengage from the latches.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
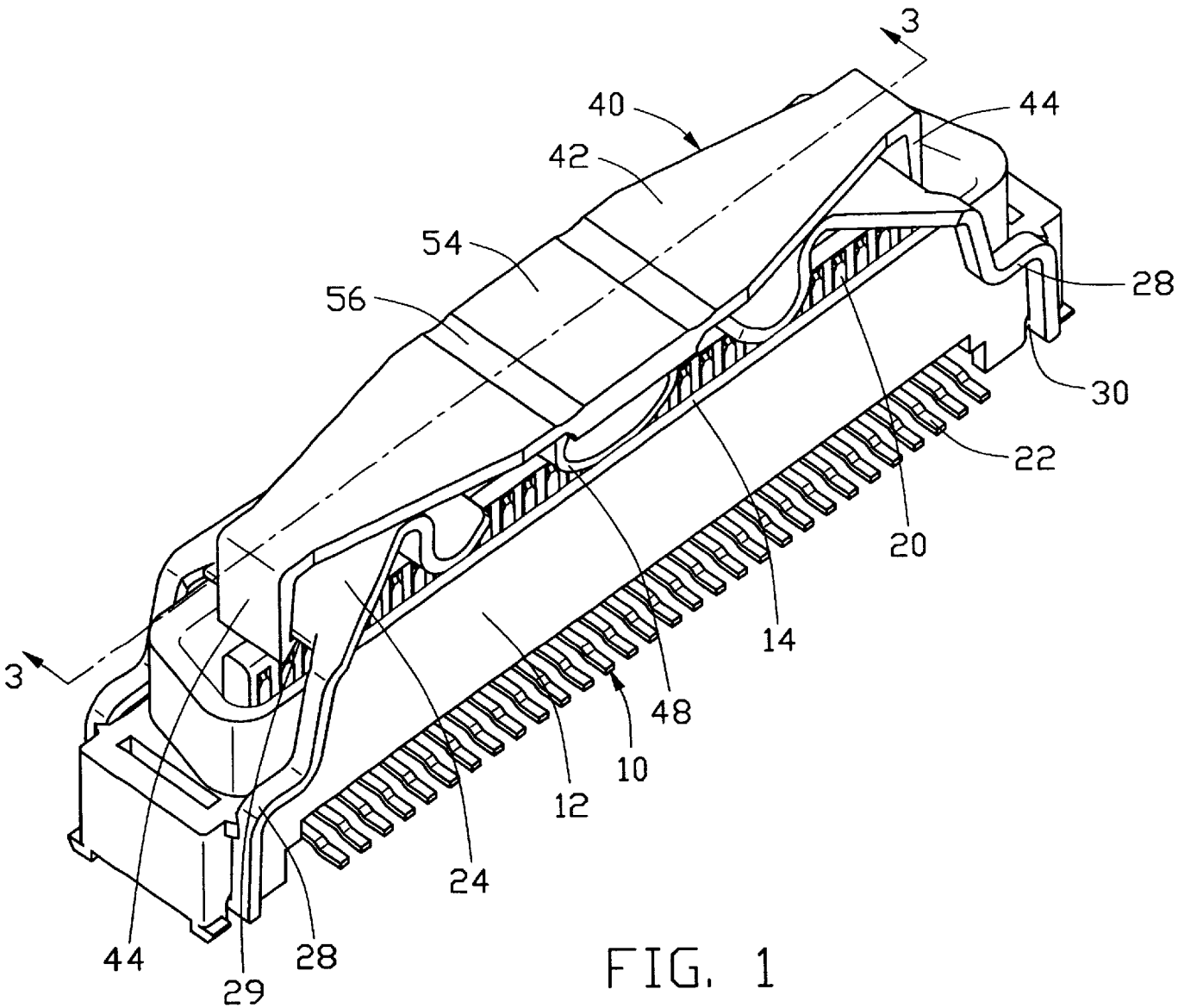
FIG. 1 is a perspective view of connector having bail latches with a pick-and-place cap in accordance with the present invention attached to the latches.
Figure 2:
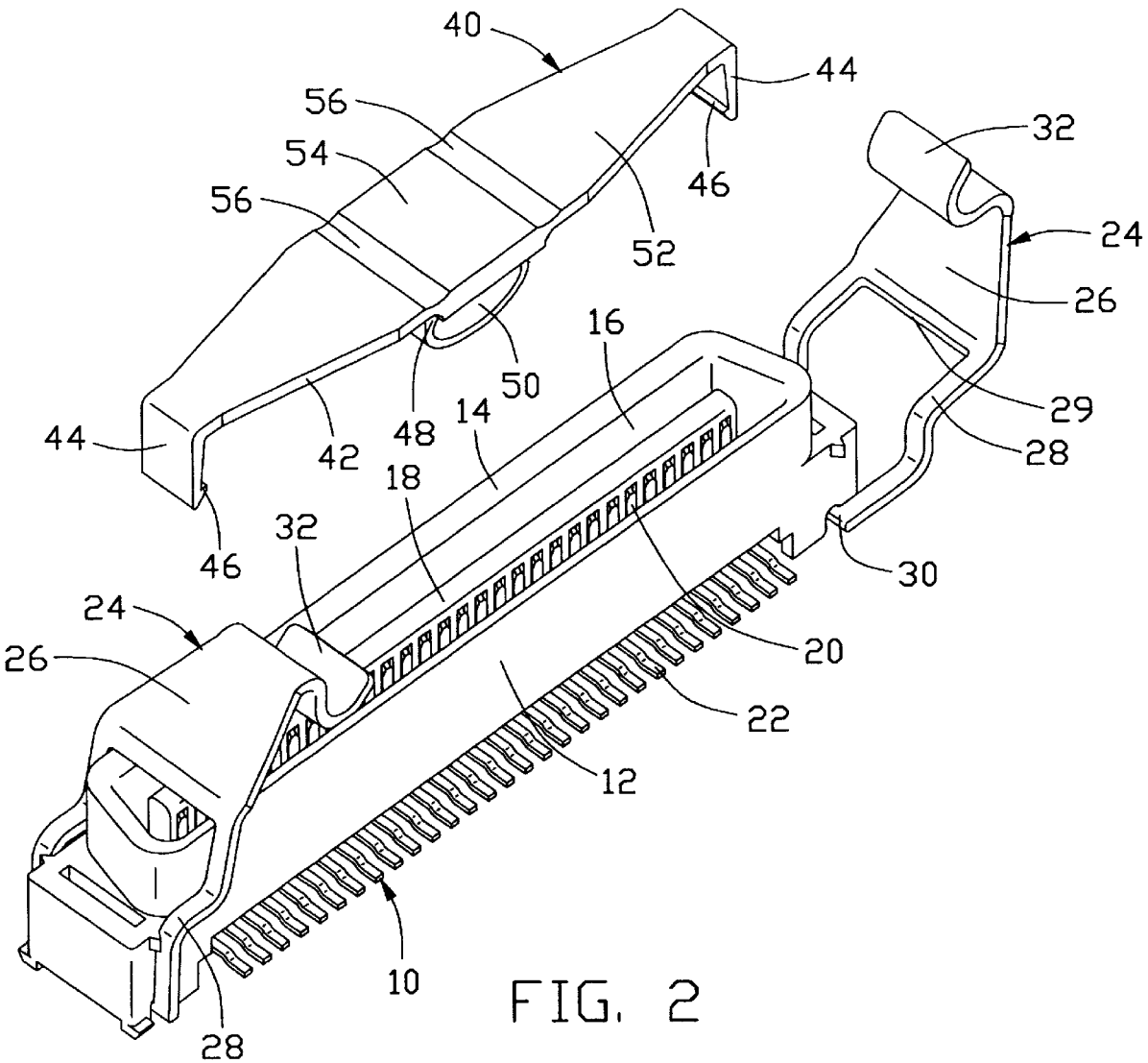
FIG. 2 is a perspective view similar to FIG. 1 with the pick-and-place cap detached from the latches.

With reference to the drawings and in particular to FIGS. 1 and 2, an electrical connector, generally designated with reference numeral 10, comprises an elongate housing 12 having a mating face (not labeled) on which a shroud 14 is formed, defining a receptacle 16 for receiving a mating connector (not shown). A tongue 18 is formed on the mating face of the housing 12 and surrounded by the shroud 14. A number of conductive terminals 20 are mounted to the tongue 18. Each terminal 20 has a tail 22 extending beyond a mounting face (not labeled) of the housing 12 to be soldered to a circuit board (not shown).

A bail latch 24 is mounted to each longitudinal end of the housing 12. Each bail latch 24 has a substantially flat body 26 and two legs 28 extending from an end 29 of the body 26 and spaced from each other for receiving the longitudinal end of the housing 12 therebetween. A cross bar 30 connects between free ends of the legs 28 and is rotatably attached to the mounting face of the housing 12 for pivotally attaching the latch 24 to the housing 12. The latch 24 forms a hook 32 on an opposite end thereof for selectively engaging a counterpart member of the mating connector to secure the connectors together.

Figure 3:
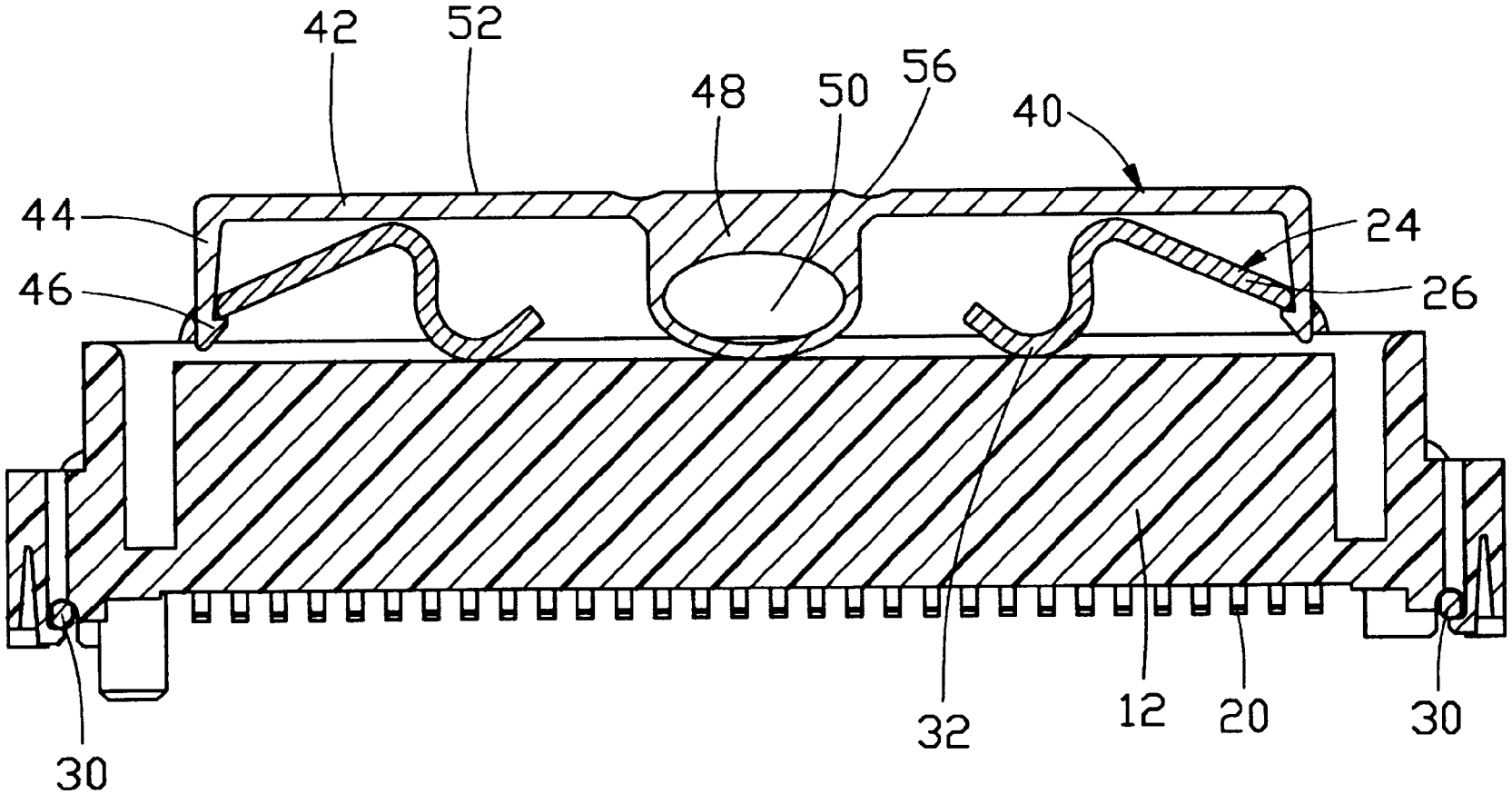
FIG. 3 is a cross-sectional view taken along line 3—3 of FIG. 1 showing the pick-and-place cap in a secured condition.

A pick-and-place cap 40 comprises an elongate flat board 42 having opposite longitudinal end portions (not labeled) from each of which a catch 44 extends. The flat board 42 is made of a material, such as synthetic material, that allows deflection of the board 42. The catches 44 have barbs 46 facing each other. A central barrel 48 is formed on a middle portion 54 of the flat board 42 and located substantially midway between the catches 44. The barrel 48 defines a central bore 50 surrounding by thin walls whereby the barrel 48 is depressible and collapsible. The pick-and-place cap 40 is sized to allow the barbs 46 of the catches 44 to engage the ends 29 of the latches 24 thereby attaching the pick-and-place cap 40 to the housing 12 of the connector 10 as shown in FIG. 3. The barrel 48 is sized to contact the shroud 14 of the housing 12 and thus supporting the flat board 40 on the housing 12.

When the catches 44 engage the latches 24, the latches 24 are forced to abut against the shroud 14 whereby the pick-and-place cap 40 secures and fixes the latches 24 in position with respect to the housing 12. The flat board 42 has a substantially flat top surface 52 capable to be firmly engaged by a suction cup of a vacuum suction device (not shown). This allows easy handling of the connector 10 by means of the suction device.

Figure 4:
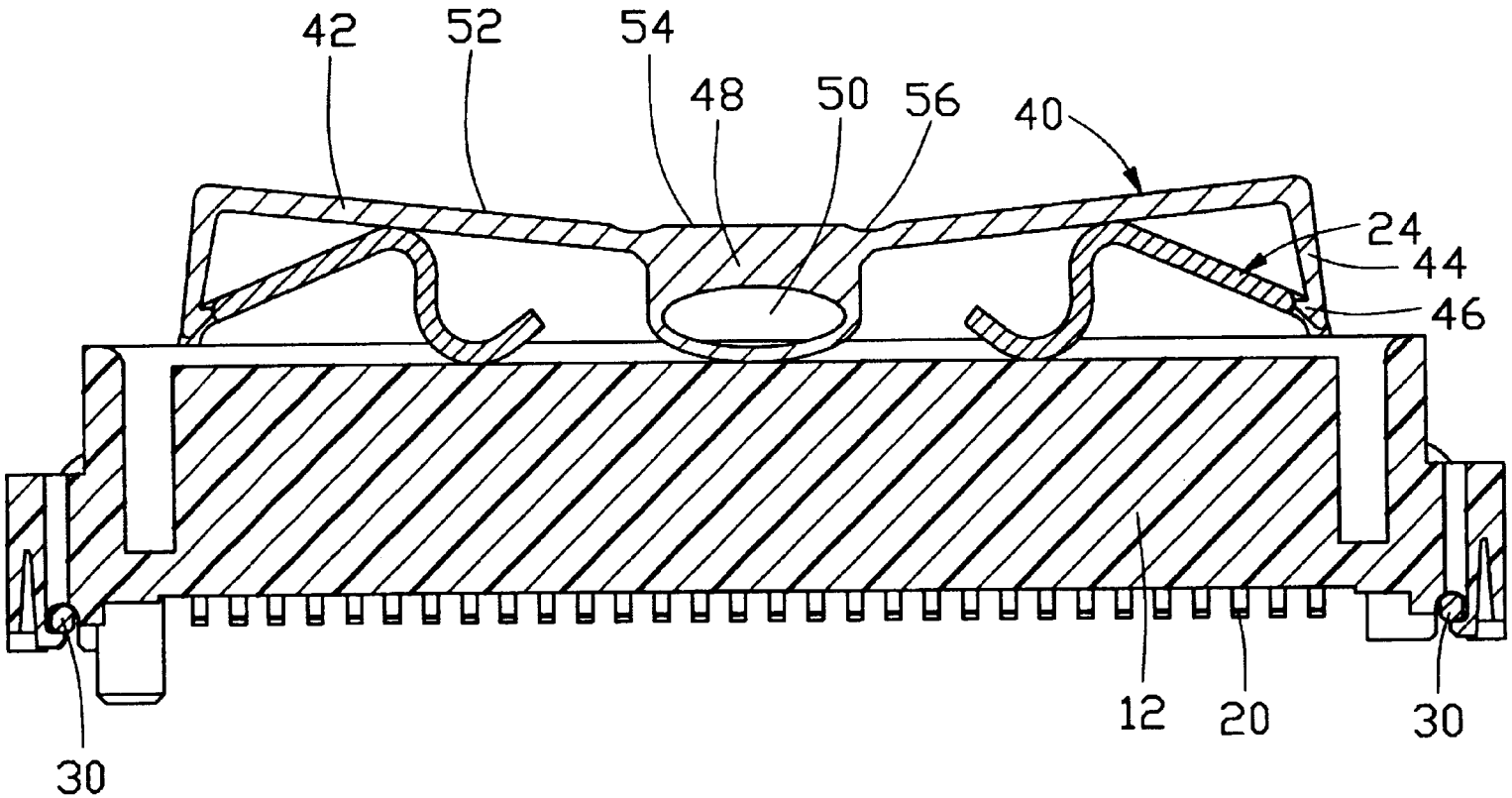
FIG. 4 is a cross-sectional view similar to FIG. 3 but showing the pick-and-place cap in a released condition.

FIG. 3 shows the secured condition where the latches 24 are secured by the pick-and-place cap 40. The collapsibility of the hollow barrel 48 allows manual depression of the middle portion 54 of the flat board 42 toward the housing 12 as shown in FIG. 4. The manual depression of the flat board 42 causes the barrel 48 to elastically deform and collapse, allowing the middle portion 54 to move toward the housing 12. The depression of the middle portion 54 toward the housing 12 causes the end portions of the flat board 42 and the catches 44 to move in a direction away from the latches 24 and thus disengaging catches 44 from the ends 29 of the latches 24. This releases the latches 24.

Two grooves 56 are defined in the top surface 52 of the flat board 42 to form two weakened lines on opposite sides of the middle portion 54. The weakened lines serve as hinges allowing the middle portion 54 to undergo relative rotation with respect to the remaining end portions of the flat board 42 in order to move toward the housing 12. It is apparent that the grooves can be defined in a bottom surface of the flat board 42 of the pick-and-place cap 40 for exactly the same function.

In case the middle portion 54 is connected to the end portions of the flat board 42 by the hinges, the flat board 42 can be made less deflectable or even rigid. The movement of the middle portion 54 with respect to the end portions can be accommodated by the operation of the hinges.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A pick-and-place cap for an electrical connector having opposite latches, the pick-and-place cap comprising:

a body having upper and lower surfaces, the body being deformable to have a middle portion thereof moved in a downward direction with respect to end portions of the body;

two catches formed on the end portions of the body and extending from the lower surface, each catch forming a barb adapted to engage each latch of the connector whereby the latches are fixed in position on the connector; and a collapsible support mounted to the lower surface of the middle portion and adapted to contact the connector for supporting the body on the connector when the latches are fixed;

wherein when the body is deflected by collapsing the support to have the middle portion of the body moved in the downward direction toward the connector, the barbs are forced to disengage from the latches thereby releasing the latches; wherein hinge means is provided between the middle portion of the body and each of the end portions, the hinge means allowing movement of the middle portion with respect to the end portions and thus deforming the body; wherein the collapsible support comprises a hollow barrel formed on the lower surface of the body.

2. The pick-and-place cap as claimed in claim 1, wherein the hinge means comprises two grooves defined in the body between the middle portion and the end portions.

3. The pick-and-place cap as claimed in claim 1, wherein the body comprises a deflectable board.

4. The pick-and-place cap as claimed in claim 1, wherein the upper surface of the body is substantially flat adapted to be engaged by a suction cup of a suction device.

5. A pick-and-place member for handling an electrical connector comprising an elongated body having first and second surfaces and further comprising a middle portion and two opposite end portions connected to the middle portion by hinge means so as to allow movement of the middle portion with respect to the end portions in a predetermined direction, two catches being formed on the end portions and extending from the second surface in the predetermined direction, the catches being adapted to engage corresponding projections extending outwardly from sidewalls of the connector for attaching the pick-and-place member to the connector, and a collapsible member formed on the middle portion and extending from the second surface in the predetermined direction, wherein the collapsible member is sized to support and maintain the middle portion at a non-actuated position where the catches engage the projections of the connector to firmly attach the pick-and-place member to the connector, the middle portion being selectively moved to collapse the collapsible member in the predetermined direction to an actuated position where the end portions are driven in such directions to disengage the catches from the projections and thus releasing the pick-and-place member from the connector; wherein the hinge means comprises two groove defined in the first surface between the end portions and the middle portion; wherein the collapsible member comprises a hollow barrel attached to the second surface of the middle portion.

6. The pick-and-place member as claimed in claim 7, wherein the hinge means comprises two groove defined between the end portions and the middle portion.

* * * * *